United States Patent [19]

Sanders, Jr. et al.

[11] Patent Number: 4,552,064

[45] Date of Patent: Nov. 12, 1985

[54] DOT MATRIX PRINTERS AND PRINT HEADS THEREFOR

[76] Inventors: Royden C. Sanders, Jr., Burton Hwy., Wilton, N.H. 03086; John L. Forsyth, Box 182, Newton Junction, N.H. 03851

[21] Appl. No.: 544,397

[22] Filed: Oct. 21, 1983

Related U.S. Application Data

[63] Continuation-in-part of Ser. No. 436,950, Oct. 27, 1982, , and a continuation-in-part of Ser. No. 519,880, Aug. 2, 1983.

[51] Int. Cl.[4] ..... B41J 3/12

[52] U.S. Cl. ..... 101/93.05; 400/124; 335/271

[58] Field of Search ..... 400/121, 124; 101/93.04, 93.05; 335/271, 279, 274, 277

[56] References Cited

U.S. PATENT DOCUMENTS

| | | | |
|---|---|---|---|
| 3,770,092 | 11/1973 | Grim | 101/93.05 X |
| 3,896,918 | 7/1975 | Schneider | 101/93.05 X |
| 4,044,668 | 8/1977 | Barrus et al. | 400/124 X |
| 4,218,148 | 8/1980 | Matschke | 400/124 |
| 4,218,149 | 8/1980 | Okada | 101/93.05 X |
| 4,236,836 | 12/1980 | Hodne | 400/124 |
| 4,278,020 | 7/1981 | Oaten | 400/124 X |
| 4,396,304 | 8/1983 | Davenport et al. | 400/124 |
| 4,403,875 | 9/1983 | Asano et al. | 400/124 |

FOREIGN PATENT DOCUMENTS

| | | | |
|---|---|---|---|
| 2469288 | 5/1981 | France | 400/124 |
| 44674 | 5/1981 | Japan | 400/124 |
| 61577 | 4/1982 | Japan | 400/124 |

*Primary Examiner*—Paul T. Sewell

*Attorney, Agent, or Firm*—Hayes, Davis & Soloway

[57] ABSTRACT

Several new print heads are disclosed for use in serial and line printers. The print head is of the solenoid operated type without stored energy magnets and has a very low mass armature beam which the solenoid specifications are matched for performance at less than 300 microseconds. Damper mechanisms are provided for absorbing recoil sufficiently that refire rates of 350 microseconds or less are achieved. A new lightweight line printer is based on the low and the overall mass of the disclosed print head. Serial printers are also disclosed.

14 Claims, 23 Drawing Figures

DOT MATRIX PRINTERS AND PRINT HEADS THEREFOR

This application is a Continuation-in-Part application of Ser. No. 436,950 filed Oct. 27, 1982 for Dot Matrix Print Head and Ser. No. 519,880 dated Aug. 2, 1983 for Improved Dot Matrix Print Head.

This invention relates to dot matrix printers and more particularly to solenoid operated print head components and assemblies for use in such printers.

The print head of the present invention is adapted for use either in a series arrangement where a column of dots are printed by print wires at once in a vertical column or in a line printer arrangement. The former is generally termed a serial printer in which the heads may either be vertically arranged in a staggered configuration across a line or mounted around the circumference of the circle with print wires converging on a line. Such a serial print head is moved across the paper to print a plurality of dots during each pass, after which the paper is advanced to the next set or group of dots. The print head of the present invention is also adapted to be mounted in a linear staggered arrangement forming a line of print wires and dot positions to be printed on the paper a line at a time. In this arrangement a shuttle is used for transporting the print head array along the line being printed, for a small number of characters (4) after which the paper is advanced for the next adjacent line during the return pass.

The print head assemblies which will be described are applicable to both serial and linear designs. The examples given will be applied to a basic configuration for a linear print head array and to several configurations of serial print head arrays.

Of the prior art U.S. Patents relevant to this invention, the following are believed to be the most pertinent.

| | | |
|---|---|---|
| 3,151,543 | 4,136,978 | 4,291,992 |
| 3,467,232 | 4,159,882 | 4,302,114 |
| 3,770,092 | 4,214,836 | 4,307,966 |
| 3,828,908 | 4,222,674 | 4,309,116 |
| 3,854,564 | 4,225,250 | 4,317,635 |
| 3,991,869 | 4,279,518 | 4,320,981 |
| 4,059,183 | 4,284,363 | 4,348,120 |

From these patents, particularly, Grim, U.S. Pat. No. 3,770,092, it is known to employ a solenoid in the magnetic circuit having a gap formed between a pole piece and a moveable armature, the armature being carried on a beam, the end of which mounts a print wire or stylus. When the coil is energized, the armature pole piece gap is closed carrying the beam and print wire to impact the paper. It is also known to arrange a plurality of solenoids in a dot matrix print head in varous configurations so as to facilitate either serial printing or line printing.

Past efforts to achieve these operating parameters with print heads operated solely by solenoids have not been very fast firing (typically having firing rates of 750–1200 microseconds). Therefore, many of the more recent designs in this field have employed stored energy arrangements in which a permanent magnet is arranged to hold back a pin or print wire and armature to close a magnetic gap. The solenoid activation cancels the permanent magnet field and releases the armature and print wire in these prior art designs. The weight of the permanent magnet in such systems has become objectionable in line printers of the shuttle type and in serial printers.

In addition, the maximum refire rate has limited the speed of the printers. The cost of manufacture was too expensive and the stored energy print heads have been notorious for poor yields and difficulty in manufacture. In particular, line printers of the type operating at speeds of 300 lines per minute or more have had to resort to complicated counterweight systems for dynamically balancing the movement of the shuttle print due to the necessary weight of the magnetic structures employed. In both the solenoid print wire design and the stored energy design, the effort has been to increase the printing speed (as given by the refire rate) while maintaining a dynamic print range (greater than 3 or $4\times10^{-3}$ inches), impact forces from greater than one kilogram, with commensurately narrow range of acceptable impact delay times (less than 300 microseconds).

In near letter quality (NLQ) printers, there is a need to refire the pins at many additional incremented refire times than in printheads used for making $5\times7$ or $7\times9$ characters. High quality letters require uniformly dark dots at refire rates of, e.g. 320, 360, 400, 440, 480, etc. microseconds corresponding roughly to 8, 9, 10, 11, 12, etc. x $10^{-3}$ inch separation between dots at 26 inches per second carriage speed and that there be no unwanted dots printed at any refire rate. U.S. Pat. No. 4,291,992 Barr et al describes an electronic damping system that was used in a commercial printer for years. Its disadvantages are complexity and extra heat dissipation in the printhead. Other print heads such as those produced by D. H. Associates of Sunnyvale, California had a relatively fast time to impact but cannot refire until the rebound energy dissipated (around 1000 microseconds).

There is a need for an improved dot matrix printer and print head which will overcome the above limitations and disadvantages.

In general, it is an object of the present invention to provide an improved dot matrix printer and print head which will overcome the above limitations and disadvantages in a new design of print head which utilizes positive solenoid operated devices and eliminates stored magnetic energy circuits while achieving state of the art performance.

It is a further object of the invention to provide a new and improved linear dot matrix printer and shuttle which is exceptionally lightweight and which is free of the requirement of counterbalancing.

A further object of the invention is to provide a dot matrix printer print head which is solenoid operated and has a minimum mass of moving parts which the specifications and induction of the solenoid are matched to the mass of the moving portion of the beam.

A further object of the invention is to provide a print head of the above character which has a time to impact of less than about 300 microseconds.

A further object of the invention is to provide print head assembly of the above character including a damper for absorbing the recoil energy of the moving elements in a time sufficiently short that the refire rate of the apparatus can be slightly longer than the time to impact, i.e. is less than about 350 microseconds.

A further object of the invention is to provide a print head operable to produce near letter quality print which requires uniformly dark dots at refire rates of 320, 360, 400, 440, 480, etc. microseconds corresponding roughly to 8, 9, 10, 11, 12 etc.$\times10^{-3}$ inch separation between dots at 26 inches per second carriage speed with no unwanted dots printed at any refire rate. This performance requires a damping mechanism that absorbs substantially all of the recoil energy and which will have no appreciable wear so as to give the print head a long life.

A further object of the invention is to provide an inertial damper mechanism for use on print heads so that substantially all of the recoil energy is absorbed in the first return motion of the moveable element.

This invention is predicated on the finding that by careful redesign and optimization of the components of a solenoid print wire arrangement, the performance characteristics of the best stored energy designs can be equalled or bettered. The design of the present invention lends itself not only to serial, moving head printer arrays, but is also found to be especially adapted to making a shuttle line printer with performance characteristics comparable to stored energy systems.

The present invention employs an improved dot matrix print head which has no stored magnetic energy components and very few parts made of heavy metal. It is very light weight throughout. The print head is an improved solenoid coil operated, moving armature type. It includes a co-axial core and coil surrounded by a shell of magnetically permeable material to form a magnetic return path. A leaf spring armature beam is cantilevered over one end of the coil and shell and carries an armature plug carefully aligned in a hole concentric in one end plate of the shell and aligned with the core with which the armature plug forms a working gap. When energized, the coil develops a magnetic field in the core to close the gap, moving the armature and beam toward the platen. The beam is flat, planar, and springy between the point of support and the armature but is stiffened by an L-shaped section between the armature and the print wire attached at the other end.

The design of the print head is such that, when the armature is at rest, the print wire (or a major portion thereof) extends in a straight line at right angles from the end of the armature so that the initial motion of the print needle is parallel to its length. The print needle passes through jeweled guides, but is so precisely aligned that its initial motion is free of the guides. This substantially eliminates frictional resistance to the start of the motion of the print needle. The armature beam is preferably stiffened at one end formed the same of an L-shaped single sheet of spring metal. The overall design gives a faster response and relatively high strength from the armature and the point of attachment of the print needle to the end of the beam.

The driving solenoid is designed with an impedance characteristic so that the solenoid charging pulse can reach maximum current intensity in less than about 150 microseconds. The current remains at maximum intensity for approximately 50 microseconds and then rapidly decreases to zero in less than a 100 microseconds. The mass and the spring constant of the beam armature print wire assembly and the coil impedance are matched to optimize beam movement. It is found that (a) after the coil current has risen about 80 percent, the beam should start to move and reach about 20 percent of its maximum movement by the time the coil current has reached maximum current or (b) that the beam commences to move within plus 100 microseconds or minus 50 microseconds of coil current reaching its maximum, preferably within plus or minus 35 microseconds of coil current reaching its maximum, more preferably at approximately 20 to 30 microseconds before the coil current reaches its maximum.

In addition, the spring armature is placed under preload by a damper so as to assure better damping action at the completion of the printing stroke. The damper effectively brings the beam to instant rest so that the refire rate can be variable and be almost as low as the time required to reach impact, i.e. 350 microseconds. This time includes both the coil operation cycle time and the time required to bring the beam motion to rest. With this preload the spring armature make a relatively small angle with respect to neutral, of between one and three degrees, and is able to make the printing stroke and return to the rest position in an extremely short period of time.

The moving mass of the beam consisting of the print wire, armature and beam is quite low, something less than the rest mass of 0.3 grams. The spring constant is 100 grams/degree, as measured by deflection of the print needle with the beam mounted.

In one embodiment of the invention designed for a serial printing, four print needles have their axes in the rest position essentially parallel and with four operating coils in close packed relationship. This permits printing a straight vertical or slanted line with simultaneously energized solenoids.

In serial print head array applications the mounting structure and movement of the array as a whole may be known in the art.

A recoil energy absorbing member preferably overlies a returning portion or end of each of the armature beams and services as a mechanism both for absorbing the return energy and for pretensioning the beam. In one form, this member is made of a shock absorbing material in a cylindrical form mounted with its axis generally parallel to the axes of the print needles. The recoil absorber can be mounted for free rotation round its axis so that, during operation, it rotates slowly and presents continually changing portions for absorbing the return impact of the print needles, preventing localized wear of the impact absorbing material.

In preferred embodiment, the recoil damper includes an inertia transfer plate or pin mounted over the full area of the damping material. The plate has an effective mass equal to the effective moving mass of the beam assembly. Upon recoil impact, the energy of the beam is nearly fully transferred to the plate and is spread through and absorbed by the damping material. The transfer is arranged in one embodiment to occur at the center of percussion or of effective mass of the beam assembly and is found particularly effective. According to another aspect of the invention, there is provided a dot matrix print head which includes a solenoid and a spring assembly for driving a print pin, with a particular positioning means for holding the assemblies in a predetermined relation. The solenoid assembly preferably has a first positioning means adjacent its upper surface and a second positioning means forming a part of the spring assembly. The first and second positioning means are preferably circumferential with the second means adapted to engage the first positioning means around more than 180 degrees of arc thereof and is expandable to permit sliding engagement with the first positioning means so as to hold the spring assembly locked onto the solenoid assembly. Preferably a molded stiffening rib is carried by the spring assembly and extends from the armature to the pin-carrying tip of the spring assembly. The molded pin support is formed integrally with the stiffening rib and permits rotation of the end of the pin in the support. It is also preferred that there be a molded pad carried by the stiffening rib to engage an impact absorbing member during the return of the printing pin from printing position.

These and other features and objects will become apparent from the following exemplary description and claims when taken in conjunction with the drawings, of which:

Figure 1:
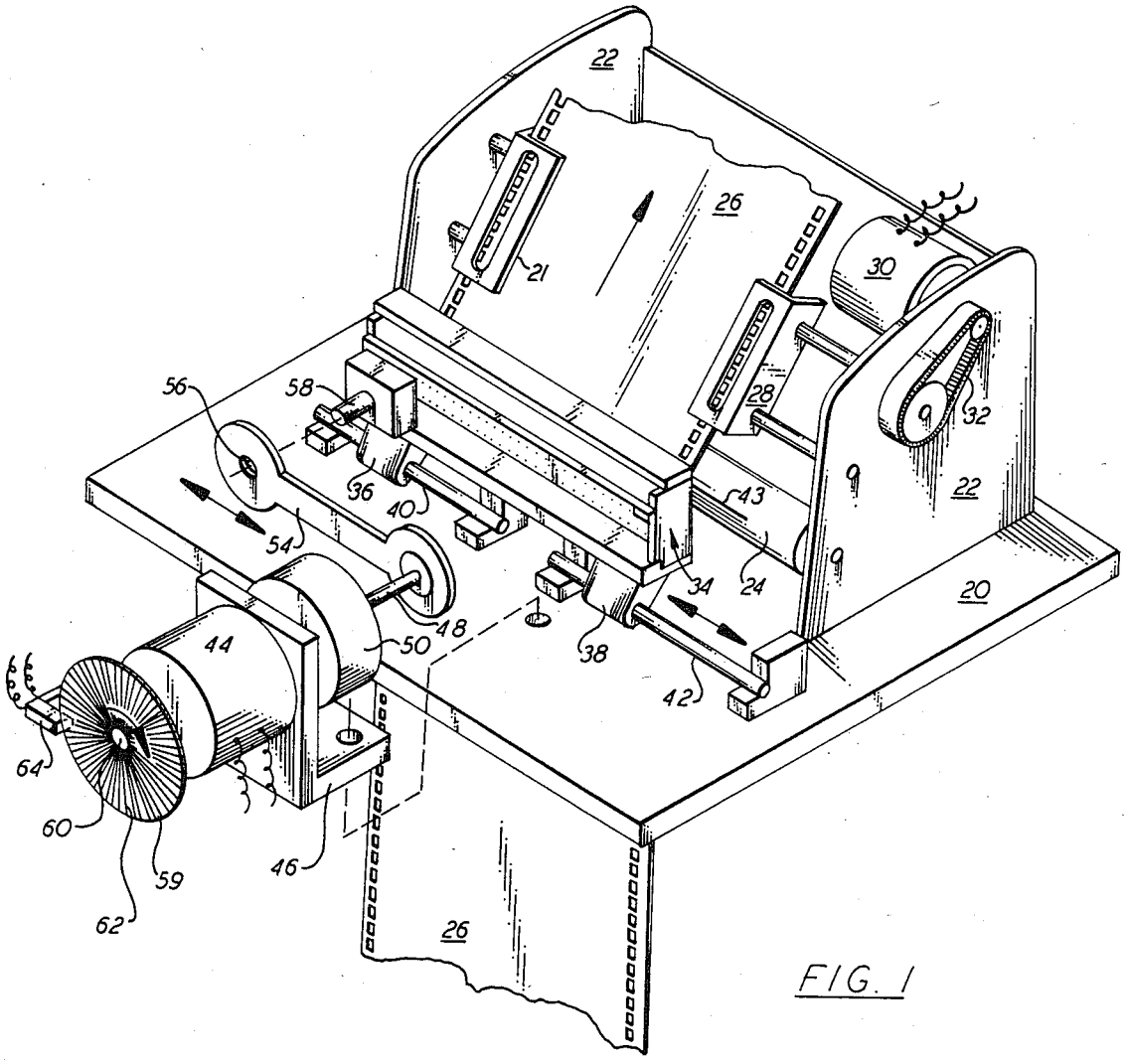
FIG. 1 is a perspective view of a linear dot matrix printer and print head array constructed in accordance with the present invention.

Referring to FIG. 1, there is shown a line printer construction in accordance with the present invention. The printer includes a base 20 carrying a frame 22, which supports a platen 24 at its forward lower end over which a paper web 26 is carried by a paper advance mechanism 28 including a web drive motor 30 and belt drive 32.

A hammer bank or print head carrying shuttle 34 is mounted on brackets 36, 38 set to reciprocate along guide shafts 40, 42 for about 4 characters back and forth along a print line 43.

Means is provided for reciprocating the shuttle back and forth and includes a motor 44 mounted to a bracket 46 and having a rotary shaft output at 48 which carries a flywheel 50. The shaft end is offset to form a crank of one-half the length of the desired reciprocation and is journaled into a connecting rod 54 to move that end in a circular path. The other end of the rod 54 is attached through a bearing 56 to a shaft 58 projecting from the shuttle case. This assembly forms a direct rotary to reciprocating motion connector having a sinusoidal motion characteristic.

Figure 2:
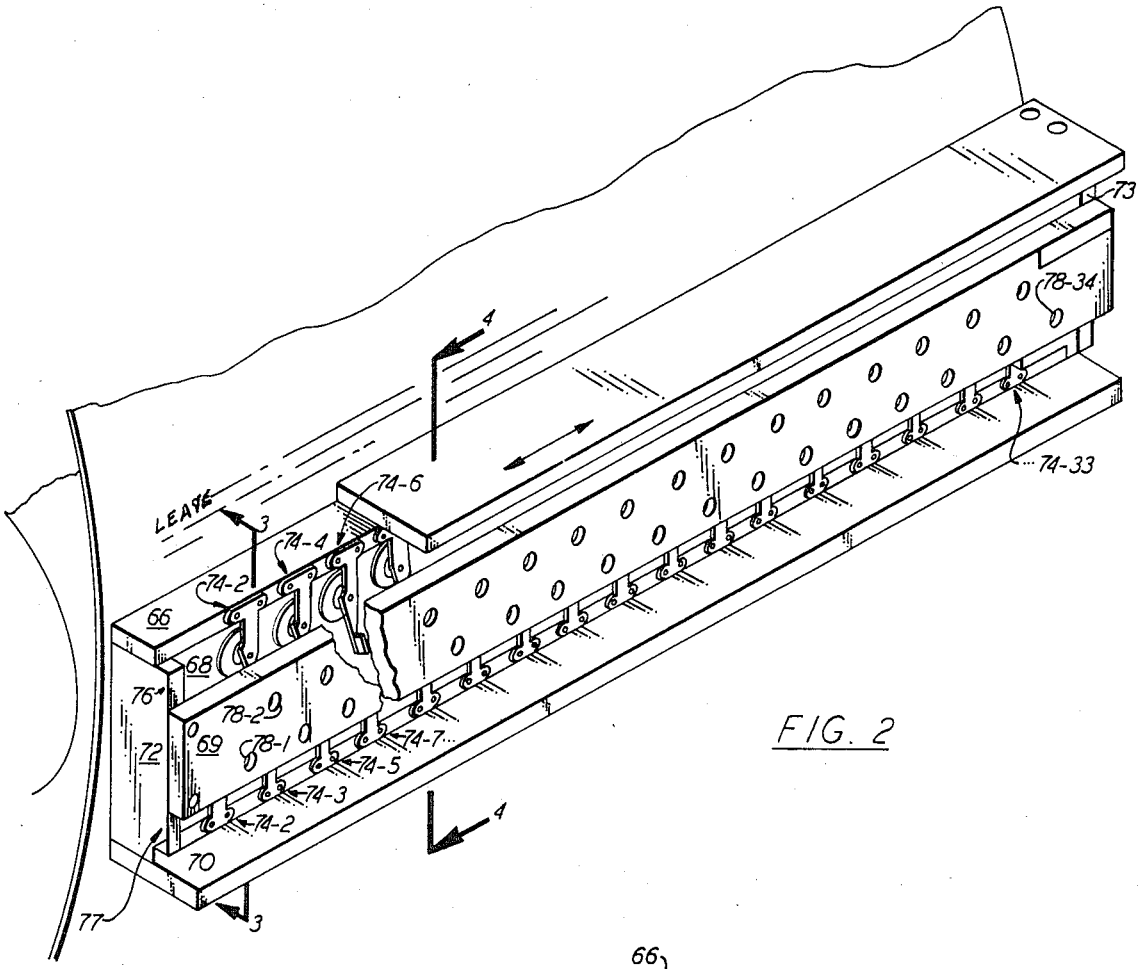
FIG. 2 is an enlarged perspective view of the print head array of FIG. 1 with portions broken away to show details of construction.

The construction of the print head can be arranged to facilitate ready removal thereof in a manner already known in the art. In addition, a bearing (not shown) is provided, in known manner, at the upper right face (as seen in FIG. 2) to support the head while permitting the desired motion thereof.

An encoding disk 59 is mounted on the other end 60 of the shaft of motor 44 and is provided with alternating transparent and opaque spokes 62 adapted to be optically sensed with a lamp and sensor 64 mounted to overlie both sides of the disk. This provides a position sensing function by which the position of the shuttle along the print line is derived from the encoder and used to control the print information control circuits, as known in the art.

Figure 3:
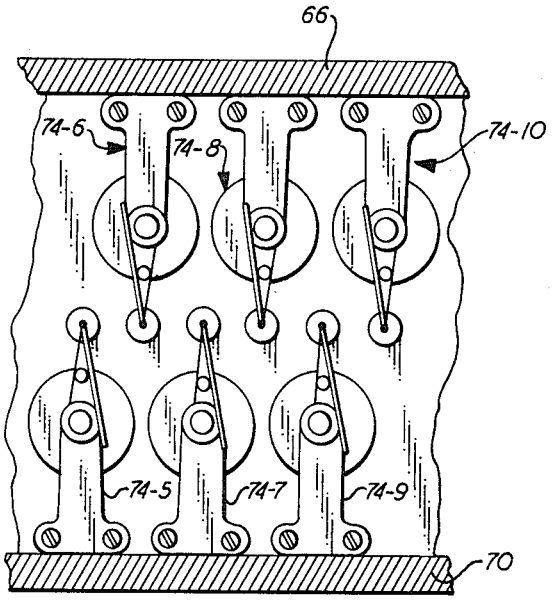
FIG. 3 is a cross-sectional view taken along the lines of 3—3 of FIG. 2.
Figure 4:
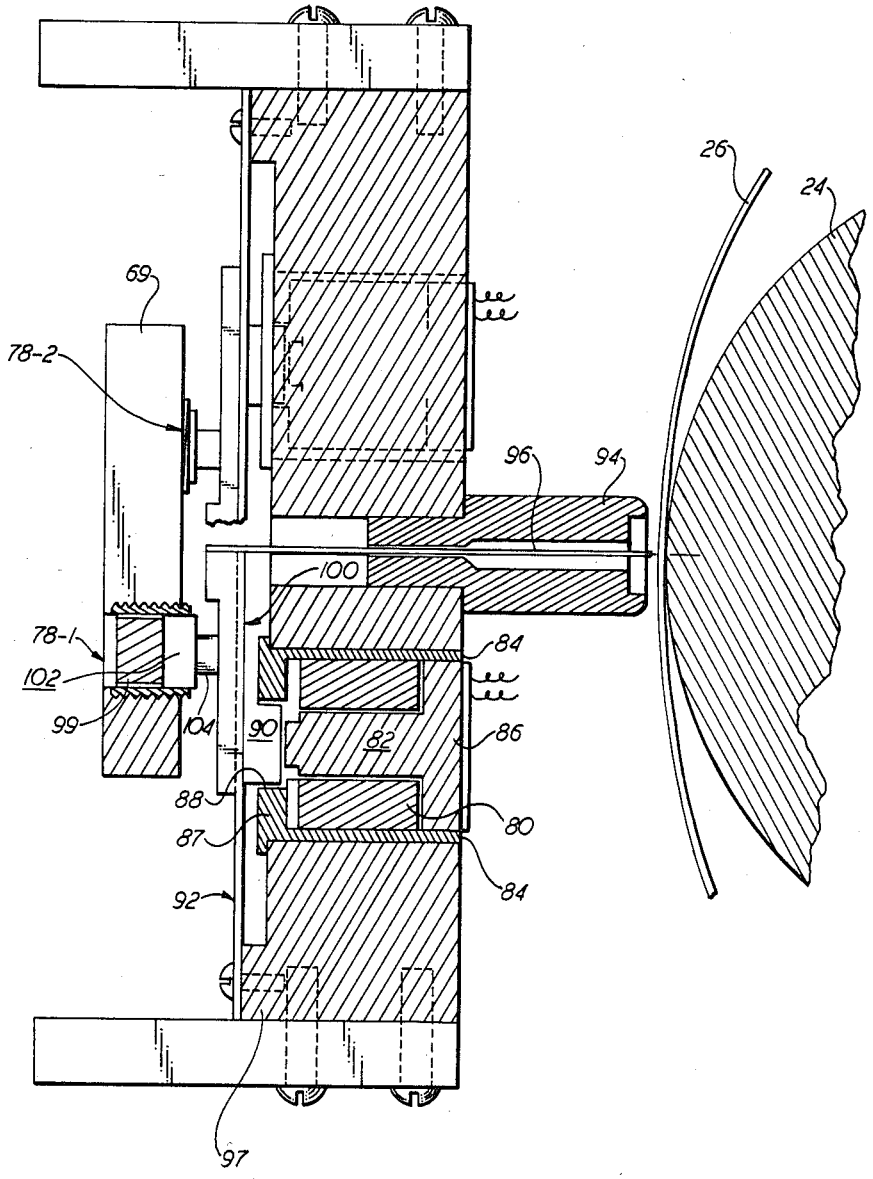
FIG. 4 is a cross-section of the view taken along the lines 4—4 of FIG. 2.
Figure 5:
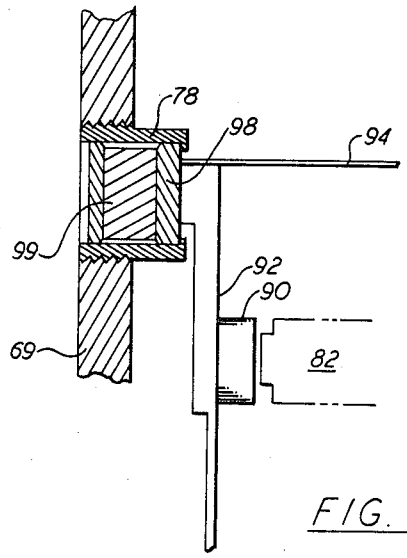
FIG. 5 is a cross-sectional view of a generalized inertial damper constructed in accordance with the present invention.

It is important to note that the movement of the shuttle can be affected without the need to employ counter weights. This results principally from the ability to reduce the weight of the shuttle by employing light weight metal alloys which may be suitably used as the principal structural component, and the absence of magnetic energy storage structures with their attendant, heavy metal, magnetic circuits. FIGS. 2–4 shows the shuttle construction in detail. Thus, a plurality of elongate aluminum bars 66, 68, 70 and end plates 72, 73 are fastened together to form a light weight frame for carrying thirty-four print heads 74-1 through 74-34 in a staggered array of two rows 76, 77 facing each other across the print line 43 on which their respective print wires are aligned. Each row is offset half the distance between heads to give an evenly-spaced, integrated set of print wires.

The back plate 69 carries a plurality of dampers 78-1, 78-2, 78-34 for absorbing recoil energy to be described later.

Alternatively, the dampers can be individually supported each from their associated beam mounting screws.

FIGS. 3 and 4 shows the print head and damper arrangement of the array of FIGS. 1 and 2. Thus, each print head includes a cylindrical solenoid 80 around a core 82 of magnetic material which may be 2% Si-Fe and encased an outer shell 84. A bottom end plate 86 completes a magnetic return path from the case to the shell 84 at one end and the shell is closed at the other end to form a top plate 87 with an aperture 88 for passing an armature 90 carried on a moveable spring beam 92. The latter has a straight print wire 94 attached at its end and extending through guides 96.

Preferably the armature 90 is spaced from the top plate 87 within the aperture 88 by a gap the reluctance of which is substantially less than the reluctance of the working gap between the armature 90 and the core 82 when the beam is at rest. The working gap, with the beam at rest, between the armature 90 and core 82 is prefereably between 0.008 and 0.012 inches.

The specific details of the print head construction are quite similar to those of the print head of the serial printers shown in FIGS. 6–10.

Figure 6:
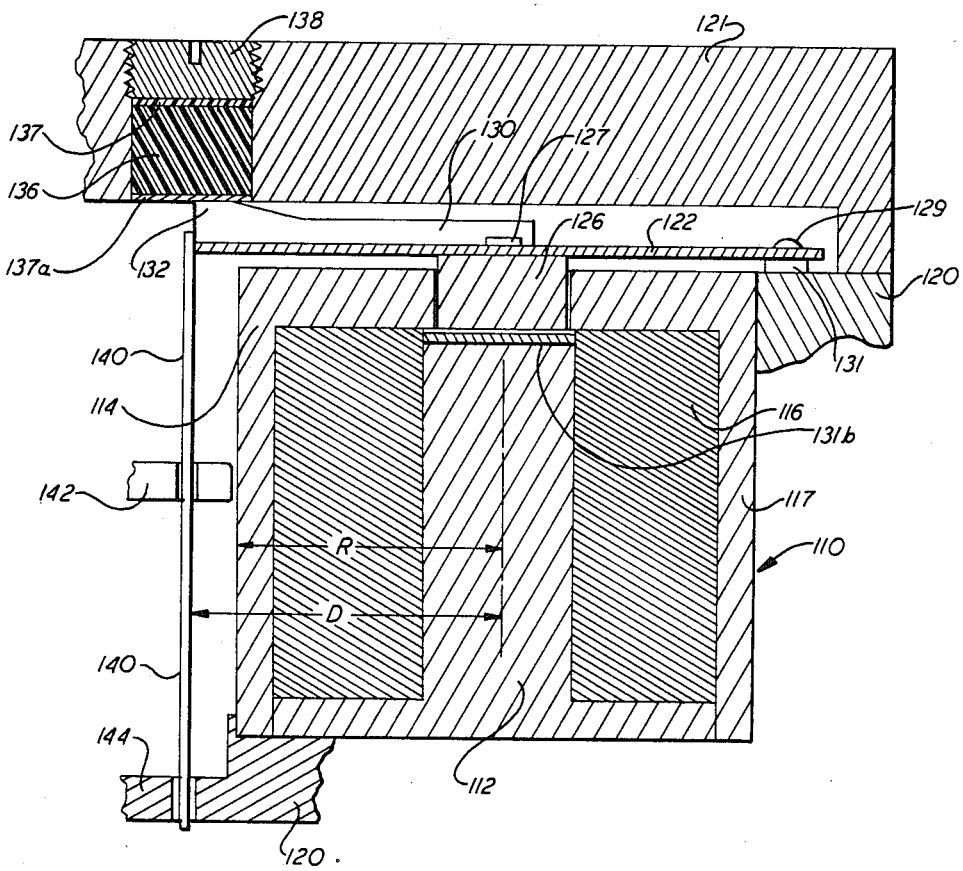
FIG. 6 is a cross-sectional view of another embodiment of print head construction in accordance with the present invention.
Figure 7:
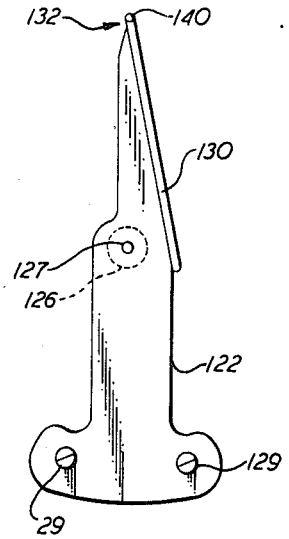
FIG. 7 is a plan view of a spring and armature beam of the print head of FIG. 6.
Figure 8:
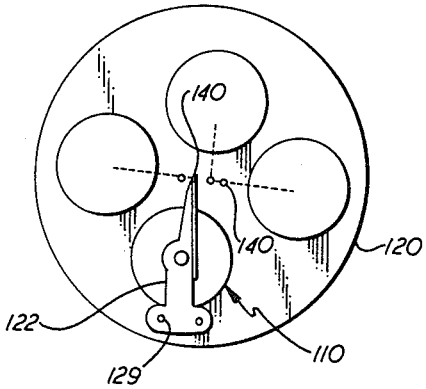
FIG. 8 is a schematic plan view of a four-pin print wire dot matrix serial printer array developed from the print head of FIG. 6.

Referring now to FIGS. 6 through 8, print heads when used in a series array are shown, each including a solenoid generally indicated at 110, having a central fixed core 112, a return path for the magnetic circuit 114 (and 117) and a low impedance actuating coil 116 confined within a outer housing 117. The radius from the center of the coil to the outer edge of the housing is indicated by the letter R. A portion 120 of the housing carrying the spring armature beams of the heads is shown generally at 120 while one of the beams for driving the print needles are shown at 122. The armature 126 is attached to the beam 122 by rivet 127. The spring beams 122 in turn are secured to the top of the housing 120 by means of screw fasteners 129. A shim 131 is positioned between the beam 122 and the top of the housing 120. Another metallic shim **131*b*, preferably of stainless steel, overlies the end of stationary core 112** to form a fixed gap in the magnetic circuit and prevent wear.

As seen best in FIG. 7, the L-shaped section 130 which extends from just beyond the attachment point 127 for the moveable armature 126 out to the end of the spring 122 to form a relatively rigid, but lightweight, section for transmitting the downward motion of the armature slug 126 to the print needle 140. The remainder of the spring from the armature to the support is essentially planar to permit ready flexure in the spring driving direction. The print needle 140 is attached by a metallurgical bond to the end 132 of the L-shaped upstanding section of the armature spring. In preferred form this metallurgic bond is a relatively high temperature solder such as a silver solder. Beam 122 with print wire and armature preferably weighs less than 0.3 grams. The recoil absorbing member is indicated at 136 as being carried by a cover 121 and comprises a cylinder of plastic such a polyurethane. Above the plastic cylinder is a disk of plastic, indicated at 137, formed of a material such as polytetrafluoroethylene or the like forming a low friction surface with the body of shock absorbing plastic 136. If desired, a layer of graphite may be provided between these two elements 136 and 137 to provide relatively easy rotation of the cylinder 136 around its axis. A screw 138 is used for ajusting the downward position of the cylinder 136, thus controlling the amount of preload compression on the beam 122.

There is also provided a second sheet of thin stainless steel (or hard plastic) **137*a* on the bearing surface of member 136 which is adapted to contact the end 132 of the beam 122 This sheet of metal (or hard plastic) is for the purpose of minimizing wear of the end of member 136**.

In a preferred form, the spring beam 122 has a total needle driving stroke of between 1 to 3 degrees around its point of flexure (effective pivot axis) and has a preload of about ½ to 1 degree. The preload is, in one preferred form, about 50–100 grams as measured at the needle driving end of the spring armature. This also specifies the spring constant as 100 grams per degree of bend.

As a result of the tilt (2 to 5 degrees) of the beam 122, the lower surface of the armature 126 is also tilted a like amount with respect to the upper surface of the stationary core 112. When the moveable core 126 is attracted to and contacts the stationary core 112, their two adjacent surfaces become parallel, thus increasing the useable attractive force between them and increasing the efficiency of the solenoid.

This tilt may be achieved by bevelling the attachment surface of the housing 120 adjacent the fastener 129 by using a tapered shim 131 under the fastener 129, or by bending the spring armature 122. As an alternative, the mating core surfaces could be bevelled a like amount.

In a preferred embodiment, the distance D between the center of the moveable solenoid armature plug and the axis of the print needle 140 is less than ⅓ inch and is about 1.1 R. As indicated in FIG. 1, the straight print needle axis 140 is essentially straight in the rest position and is carefully aligned which means that the wire has minimal bearing force against the two guide bearings 142 and 144 which guide the print needle in its initial portion of the print stroke.

In a further preferred arrangement the distance from the center of the armature 126 to the print needle attachment point being greater than the distance from the effective pivot axis (i.e. point or axis of flexure) of the beam to the center of the armature. In desired constructions these distances may have a ration of between 1.0 to 3.0 or even more desirable between 1.0 and 1.5.

The specific arrangement of the four solenoids and the spring beams (only one of which is fully illustrated) around the print needles is shown in FIG. 8 wherein like numbers refer to like elements in FIGS. 6 and 7.

Figure 10:
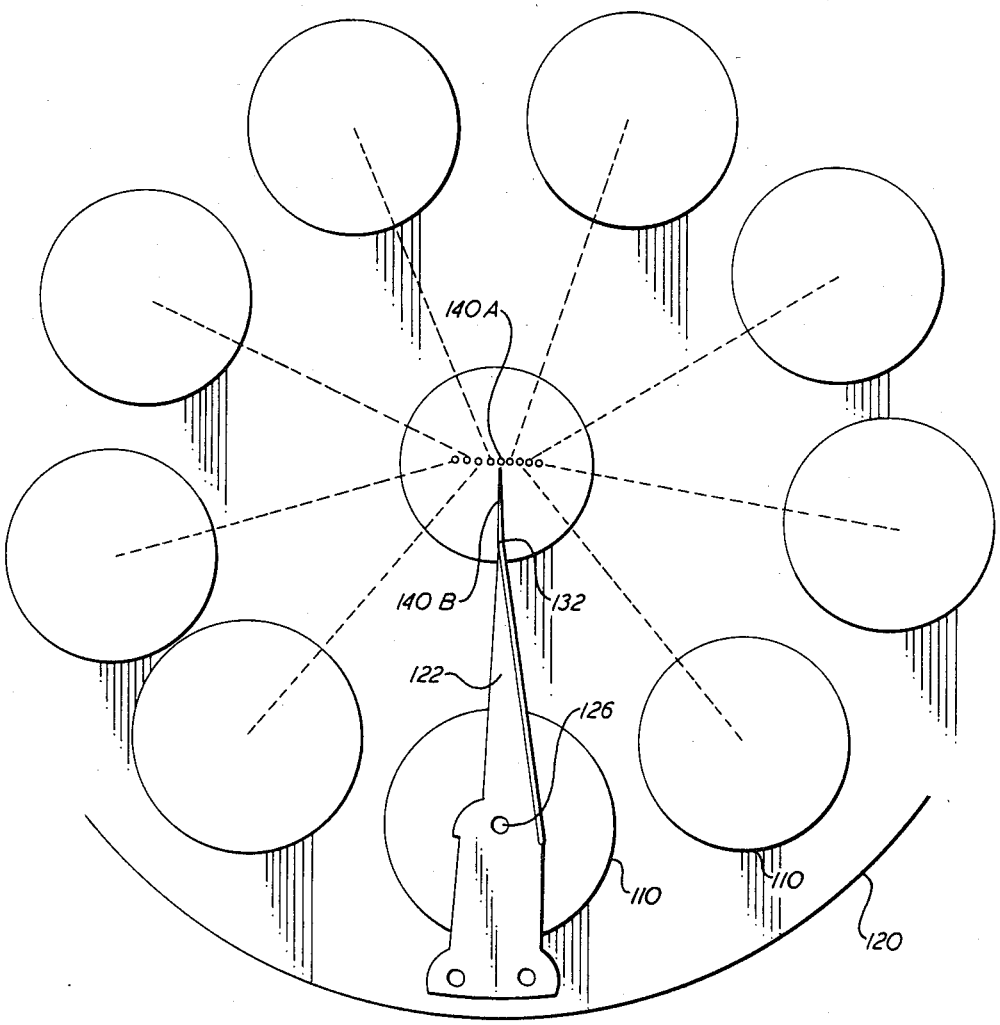
FIG. 10 is a plan view of the layout of a nine-pin serial printer array developed from the print head of FIG. 9.
Figure 9:
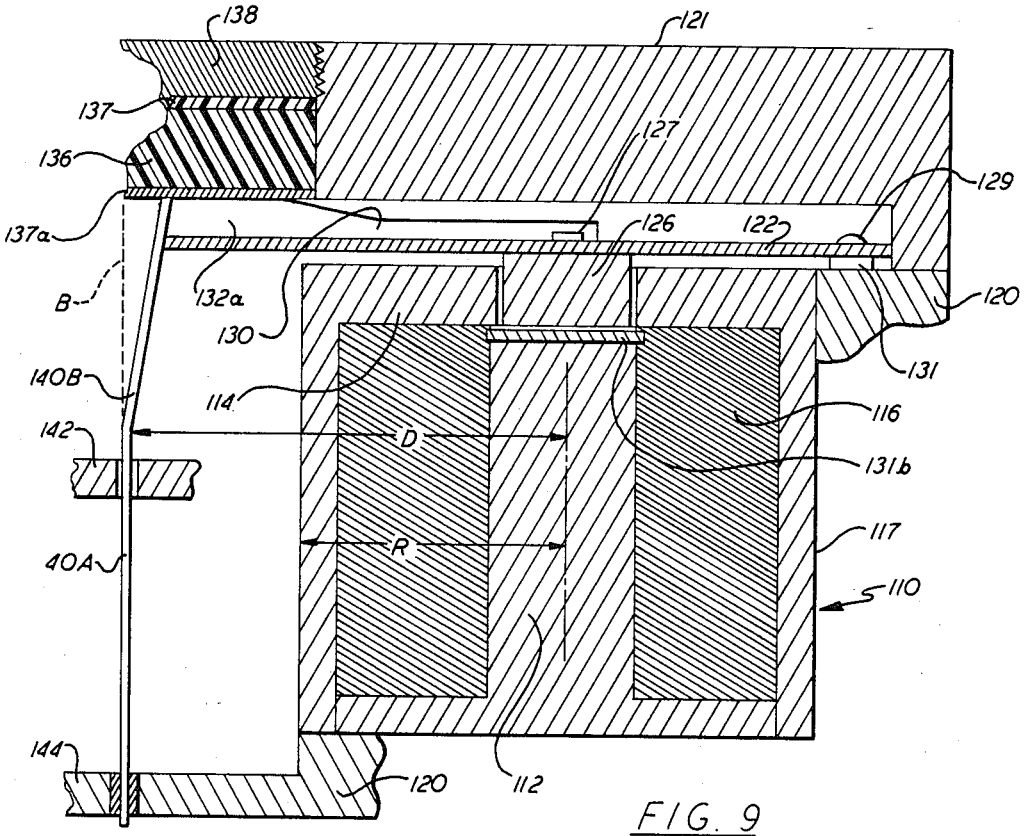
FIG. 9 is a cross-sectional view of another embodiment of a print head constructed in accordance with the present invention.

Referring now to FIGS. 9 and 10 there is shown another preferred embodiment of the invention used with a nine needle dot matrix print head. In these figures, like numbers refer to like elements in FIGS. 6 through 8. As can be seen in this case, the print needle 140 has a somewhat modified form in that it has two axes. The lower and major portion of the axis of the print needle **140*a* is straight and parallel to the axes of the two bearings 142 and 144. The upper, minor, portion of the print needle 140*b* is bent at a slight angle B from the major axis of the print needle, (this angle being somewhat exaggerated for clarity), and is preferably about 6 degrees. Similarly, the end 132*a* of the spring armature is at an angle corresponding to the angle B so that a good metallurgical bond can be obtained with the upper end of the print needle 140*b*. In other respects, the various elements of the combination are essentially the same. However, in this case, as can be seen, the ratio between D and R is considerably greater than 1.1. With this modified form of the invention as shown in FIG. 9, the nine print needles can still be arranged in a straight line in a compact fashion with the solenoids being arranged around the plane of the nine print needles as schematically indicated in FIG. 10**.

In FIG. 9, only one spring armature is shown. However, the approximate positions of the solenoids is shown around the plane of the nine print needles which are shown schematically at 140. In the FIG. 10 form of the invention, the initial downward driving force transmitted from the end of the armature 132*a* to the print needle 140 is parallel to the axis of the major portion 140*a* of the print needle, and the print needle or wire is aligned straight through the center of the guides so that there is no initial lateral force transmitted to the sides of the two bearings 142 and 144, thereby eliminating starting friction of the print needles to provide a fast print time.

The forces of impact between the moveable armature and the core in the print head of the present invention would make contact at about 6 degrees, if all the parts are arranged at right angles to each other. It is important, however, that friction between the core end face and the armature be minimized. The shim on the core serves to minimize this function by choice of material (Mylar) and also serves to prevent total collapse of the gap between these parts, so lessening the impact, both of which contribute to lower wear.

Additionally, a shim (not shown because of thinness of section) having an angle of about 6 degrees is preferably interposed between the mounting block 97 and the beam 92 in FIG. 4, or between the block 131 and beam 122 in FIG. 6, in order to increase this angle by 6 degrees This results in a nearly flush contact between these parts to spread the impact and give significantly less rubbing. There is also less mechnical vibration since the tendency to bend the beam about the point or line of impact is substantially removed.

The damper systems of the embodiment of FIGS. 1–10 will now be discussed. FIGS. 6 and 9 show dampers 136 which have protective coverings. As dampers, these units are dependent upon the characteristics of the material of which they are made. Preferably, the dampers are made of polyurethane elastomer such as available under the trademark SORBOTHANE from Hamilton Kent, Division of BTR Corporation, Kent, Ohio, or others having similar shock absorbing character. In general, the mass mismatch between the elastomer of the damper material and the beam limits the transfer of energy. This limit is much improved if an inertial damper is employed as shown in FIG. 3 and in a more general version in FIG. 5. In the latter, an impact plate 98 of stainless steel is coupled to the front surface of the damper elastomer as with adhesive 99. The equivalent mass of the plate 98 (adjusted for some contribution from the elastomer) and the moving mass of the beam are made the same Then, upon impact, all or nearly all of the recoil energy of the beam can be transferred to the plate in the manner known from billiards. The damper housing is threaded into the support plate to facilitate preload adjustment.

In FIG. 4, the inertial damper has been arranged to be even more effective. It is now located along the beam to approximately the center of the mass, or more precisely to the center of percussion, at 100. The shape of the inertial element is now in the form of a pin with a head 102 coupled to elastomeric plug 99 of the damper and a depending part 104 of smaller cross-section in contact with a more limited area at the center of percussion.

It will be appreciated that the inertial damper herein described is not limited to use in print heads. Such an inertial damper is usable in any mechanism in which it is desired to transfer all or nearly all of the kinetic energy of a first member to a second member in such a combination with a damping structure.

Figure 11:
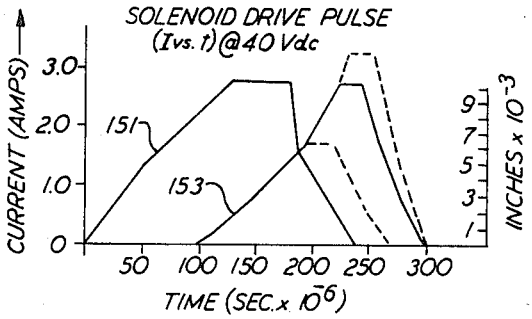
FIG. 11 is a plot of the solenoid coil charging current and the print wire motion as the function of time and generally represents these functions for the embodiments of FIGS. 1 through 10.
Figure 12:
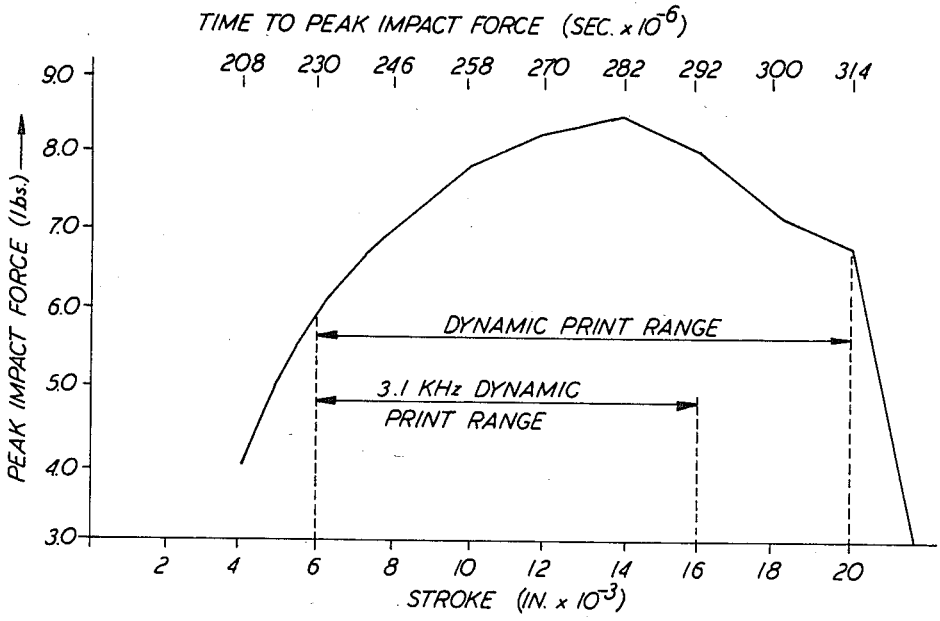
FIGS. 12 and 13 are plots showing performance characteristics of the invention as applicable to the embodiments of FIGS. 1 through 10.
Figure 13:
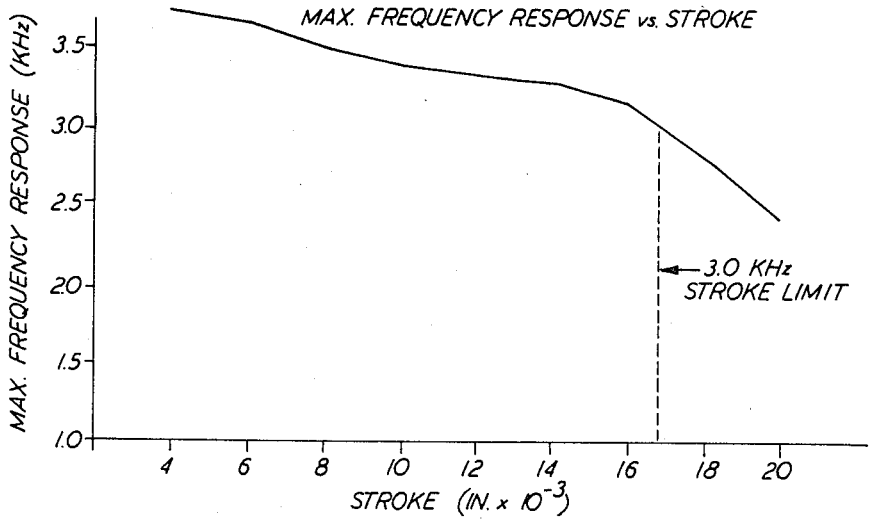

Referring to FIG. 11, there is shown a plot 151 of a solenoid drive pulse wherein solenoid charging current I is plotted against time in microseconds. As can be seen the low impedance of the solenoid permits the current to rise rapidly so that at some time between 100 and 150 microseconds, the maximum charging current of slightly less than three amps is attained. This current is retained for about 50 microseconds and the current then rapidly drops to zero to provide a total drive pulse of approximately 250 microseconds. Also given is a plot 153 of a typical print wire motion in mils (other examples of motions being shown in phantom) plotted against the same time interval as the drive current. It is an important feature of this invention that the mass of the moving armature beam and print pin is made as low as possible consistent with requirements of stiffness, flexibility and magnetic function. Having achieved this, which is at about 0.3 grams, and a flexibility allowing a less than 100-microsecond return, the solenoid is matched to the requirement of moving the beam with adequate force in the 300-microsecond time frame allowed. This has been further found (a) to require the drive current function to achieve about 80 percent of its full value before the beam moves and the beam to reach 20 percent deflection as the current reaches full value, or (b) the beam to commence to move within plus 100 microseconds or minus 50 microseconds of coil current reaching its maximum, preferably within plus or minus 35 microseconds of coil current reaching its maximum, and more prefereably at approximately 20 to 30 microseconds before the coil current reaches its maximum. 25 microseconds has been found to be about optimum. This relationship is shown in plots 151, 153. The solenoid windings for the beam described herein are: 180 turns of #31 coated magnet wire on a core 0.134 inches inner diameter, and stepped to 0.175 inches and 0.345 inches outer diameter, inductance of 1.6 millihenries open.

The curve 151 cannot be made too fast, i.e., it cannot rise too short a time lest it plateau before the beam starts to move. This condition can lead to a stall, as well as unnecessary heating in the excitation circuit. Normally, there is sufficient lag due to eddy current buildup alone, however, so that an optimized solenoid design can achieve the parameters given.

The following are typical print head specifications (1, 2, 4, 8, 9, and 34 pins).

Impact Force—5 pounds minimum on strokes across 6 to 14 mil gaps and at any refire rate up to maximum.

Maximum Refire Rate—3000 Hz on 1, 2, 4, 8, 9 and 16 to 64 pin print heads.

Time to Impact—210 microseconds at 6 mil gap to 260 microseconds at 14 mil gap.

Current Strobe—160 to 180 microseconds.

Maximum Current—2.8 + or −0.2 Amperes

Coil Dissipation—less than 2 millijoules per dot.

Coil Temperature Rating—200 degrees Centigrade.

Number of Copies—The print head can print 6-part forms. If less than 6-part forms are acceptable, the print head can be modified to produce improvements in gap variation, noise level, etc.

Print wire Diameter—available in 10, 12 or 14 mils.

Pin Configuration—2 or 4 pins on 28 mil spacings. 8 or 9 pins on 14 mil spacings, either straight or staggered. 34 pins spaced horizontally at minimum of 200 mils.

| Mechanical Dimensions | |
|---|---|
| 4 pin print head: | 1.5 inch diameter, 1.5 inch thick. |
| 8 or 9 pin head: | 2.1 inch diameter, 1.5 inch thick. |
| 34 pin head: | 2.0 inch wide, 1.5 inch thick, and 14.2 inches length. |

Figure 14:
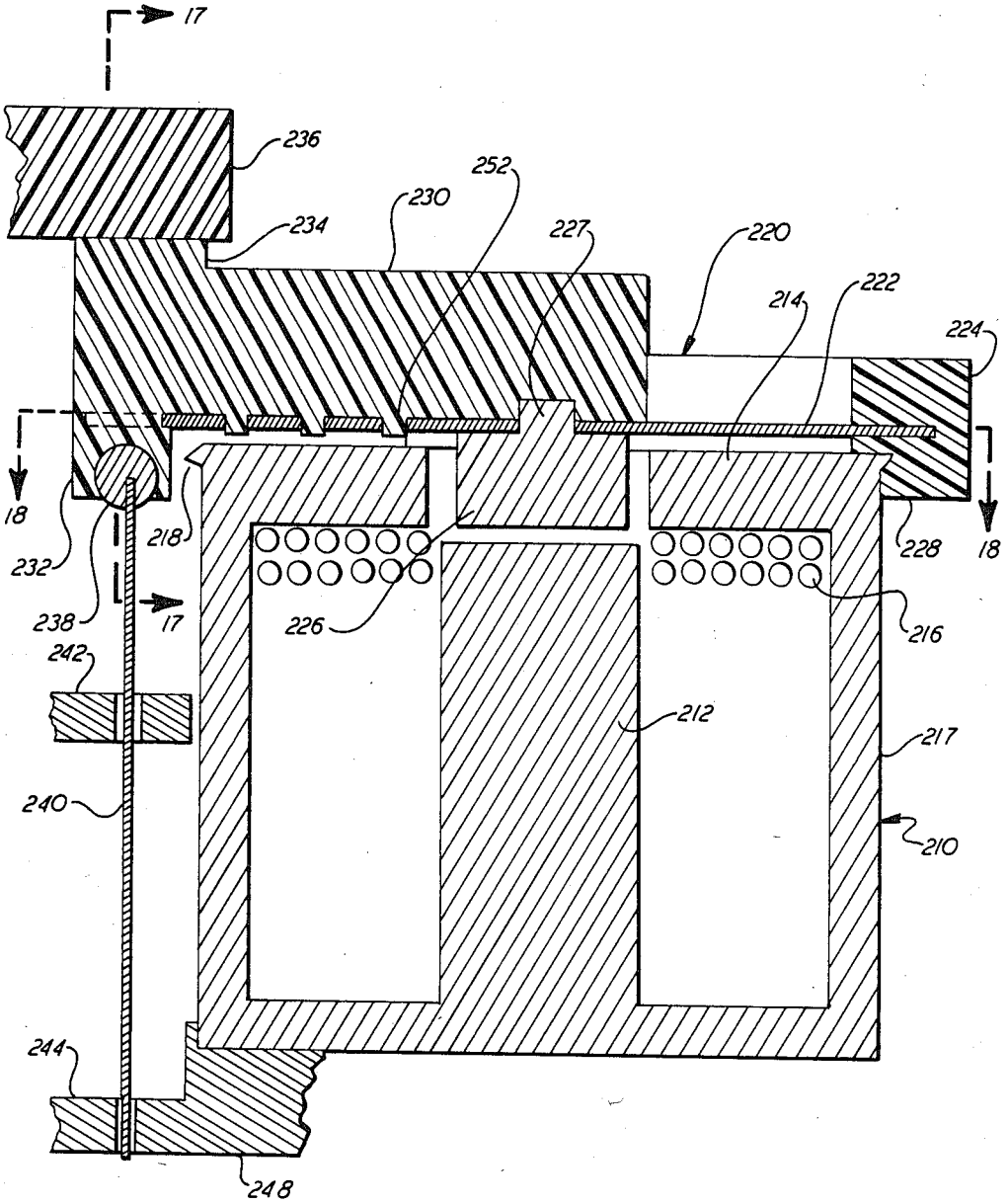
FIG. 14 is a cross-sectional view of another embodiment of print head constructed in accordance with the present invention and emphasizing certain improvements in materials technology and production technique.

Referring now specifically to FIG. 14, there is shown another embodiment of solenoid assembly generally indicated at 210, comprising pole piece 212 with return path 214 and energizing coil 216 (a portion only of which is shown). The exterior of the housing 217 is cylindrical and forms part of the return path and has an outwardly extending annular lip 218, of generally triangular cross-section, shown at the upper edge of the solenoid assembly. The spring assembly, generally indicated at 220, comprises a leaf spring 222 and an integrally molded plastic positioning means 224 which subtend more than 180 degrees of arc around the housing 210 of the solenoid assembly. Groove 228 (of cross-section to match that of lip 218) in the positioning means 224 intimately engages the outwardly extending lip 218 on the solenoid assembly 210 and holds the spring assembly fixedly secured thereto. As can be seen, particularly from examination of FIG. 18, the positioning means 224 comprises two arms which extend around the periphery of solenoid 210 and extend around somewhat more than 180 degrees of circumference. When the two arms are forced into position, the arms being slightly flexible, they tightly grip the solenoid assembly 210 and lock the spring assembly in a predetermined fixed relationship to the solenoid assembly.

The spring assembly 220 also carries armature 226, which is secured to leaf spring 222 by a suitable fastening means 227. A stiffening rib 230 is molded integrally with the leaf spring 222, this being formed of a suitable high impact plastic and being provided with a downwardly extending outer portion 232. This portion 232 has a cylindrical recess for holding a ball 238 forming the top of a print pin 240. The stiffening rib 230 extends along spring 222 from the outer portion 232 to at least the location of the armature 227 and is disposed, in plan symmetrically about a line centered on the pin 240 and the armature 227. The spring may terminate at or short of portion 232 or may extend into portion 232 as shown in ghost in FIG. 14. A portion of the spring between arms 224 and rib 230 is not reinforced in order to provide a desired spring action. Adjacent to the upper outer surface of stiffening rib 230 is an integral pad 234 adapted to engage a shock absorbing member 236 associated with the print head housing (not shown). Member 236 is preferably formed of plastic having energy absorbing characteristics. Guides 242 and 244 serve to guide the print pin during the printing stroke. A support 248, partially shown, positions the solenoid 210 and its spring assembly 220 with respect to the guides 242 and 244.

In manufacturing the leaf spring assembly, the spring and its associated armature 226, are placed in a jig. The positioning arms 224 and the elements associated with the stiffening rib 230 are then molded around the leaf spring 222. To intimately bond the rib 230 to the leaf spring 222, holes 252 are provided, which permit the plastic of rib 230 to securely bond to the leaf spring 222. A preferred embodiment of the leaf spring also provides extensions 250, which extend into the molded arms 224 of the positioning means. During the molding operation, the enlarged head of the print pin 238 is also positioned in the jig so that the depending portion 232 of the stiffening member partially surrounds the ball 238 and holds it in a fixed relationship to the spring. The ball 238 and socket in the portion 232 are arranged so that there is no bonding of the materials whereby the pin can pivot about the center of the ball within the limits dictated by the opening of the socket. To permit this slight rotation of the ball in the depending portion 232, in a preferred embodiment, the surface of the ball of the enlarged head 238 is treated (e.g., with a release agent) so that it does not bond tightly to the plastic forming the depending portion 232.

In assembling the devices described above, the spring assembly is forced onto the upper end of the solenoid assembly being held fixedly by means of arms 224 which are slightly spread apart in order to pass over the maximum diameter of the positioning lip 218 carried by the upper surface of the solenoid assembly.

In operation of the device, the solenoid coil 216 is operated and it attracts armature 226 which moves the spring and stiffening member 230 downwardly to impart a printing force to the print pin 240. When the brief printing pulse is terminated, the spring 222 forces the print pin 240 upwardly and the shock absorbing surface 234 on the top of the stiffening member 230 impacts shock absorbing member 236. Member 236 defines the upper limit of the return path of the stiffening member 230 and surface 234 after a print stroke. Member 236 serves to dampen the blow and the spring assembly is held in the position shown in FIG. 14 by means of the spring 222, the whole assembly being ready for the next printing stroke.

While a preferred embodiment of positioning means has been described above, numerous modifications can be made therein. For example, the lip 218 could be carried by arms 224 and a working groove could be provided in the upper surface of solenoid assembly 210.

Figure 15:
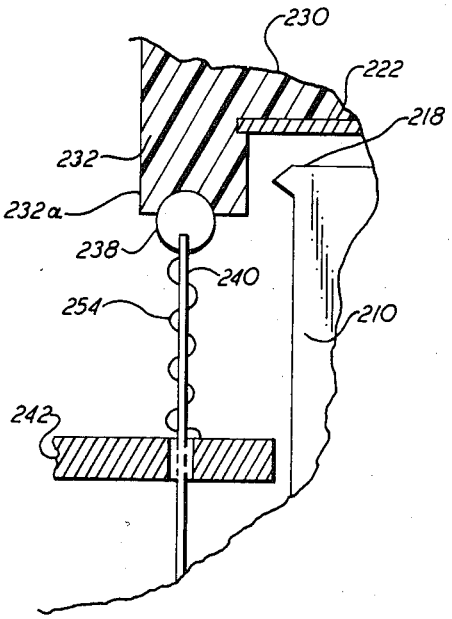
FIG. 15 shows a portion of FIG. 14 (partially in cross-section) with a modification of the invention thereof.

The preferred method of supporting the print pin 240 includes the depending portion 232 of the stiffening member which surrounds the head 238 of the pin. If it is desired to operate the print pin in the ballistic mode, the bottom part of portion 232 is removed so that portion 232 no longer surrounds head 238 but merely contacts and laterally locates the rounded head 238. This modification is shown in FIG. 15 wherein surface **232*a* contacts the upper surface of rounded head 238 for imparting a driving (printing) force to pin 240. In this case, a separate spring 254 is provided for returning the pin 240 to refire position after the printing stroke. If spring 254 is relatively weak it will permit the pin 240 to operate in the "ballistic mode", e.g., the head 238 will leave contact with surface 232*a*. If spring 254 is relatively strong the pin will operate in the "compression mode", e.g. the pin head 238 will remain in contact with surface 232*a*** during the whole print stroke.

Figure 16:
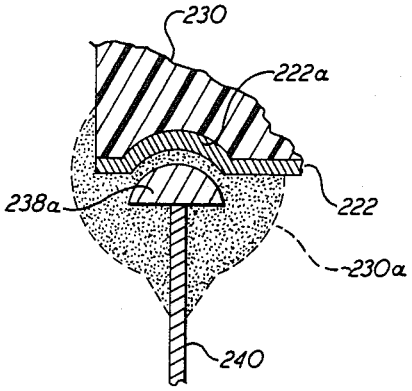
FIG. 16 shows a portion of FIG. 14 similar to that shown in FIG. 15 with a still further modification thereof.
Figure 17:
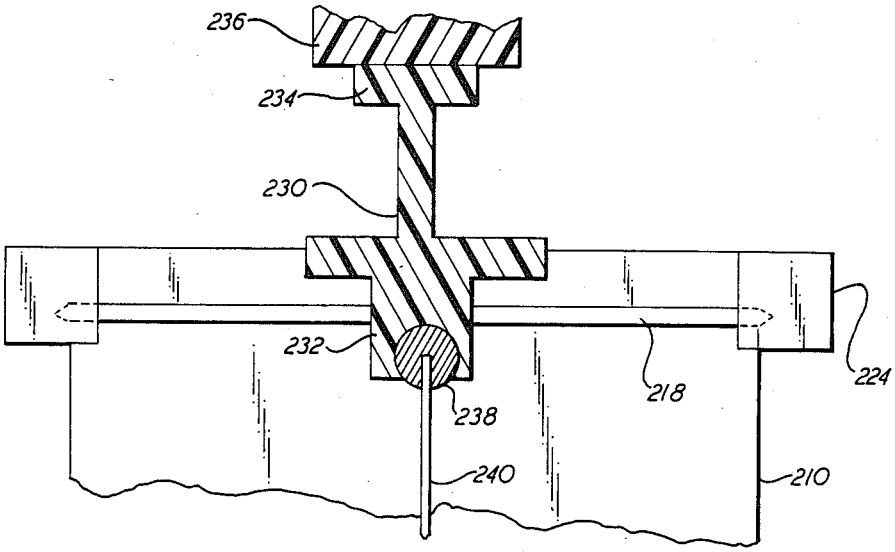
FIG. 17 is a sectional view taken along the lines 17—17 of FIG. 14.

In still another embodiment of the invention shown in FIG. 16, the leaf spring member 222 extends over the end of the print pin and has a coined recess **222*a* having a spherical concave surface which matches the end radius 238*a* of the print pin 240. This radius 238a may be a cold headed end of print pin 240 or can be separate metal or plastic hemisphere or part sphere secured to the end of the print pin 240. In either case the print pin end 238*a* can be carried by the spring by being encapsulated as shown in phantom lines at 230*a* by the plastic of the stiffening rib 230 or by a separate more flexible, plastic such as silicone rubber (RTV) as sold by Dow Corning, Inc. If the print pin of FIG. 16 is to be used in the ballistic mode it will have the spring 254 of FIG. 15**.

In a preferred embodiment of the invention the print wire is a steel wire having a diameter of 0.014 inch. A suitable plastic for molding the arms 224 and stiffening rib 230 is a high temperature resistant Nylon 166+ carbon fiber compound such as sold by Fiberfil Inc., Evansville, Indiana et al. The spherical recess in the leaf spring of FIG. 1*b* can have a radius of 0.100 inch with a depth of 0.006 inch if it is to match a fairly large end 238 on print wire 240 where the end 238 of print wire 240 is cold headed to a spherical radius of 0.014 inch then the recess 222*a* also preferably has a 0.014 inch radius.

Figure 18:
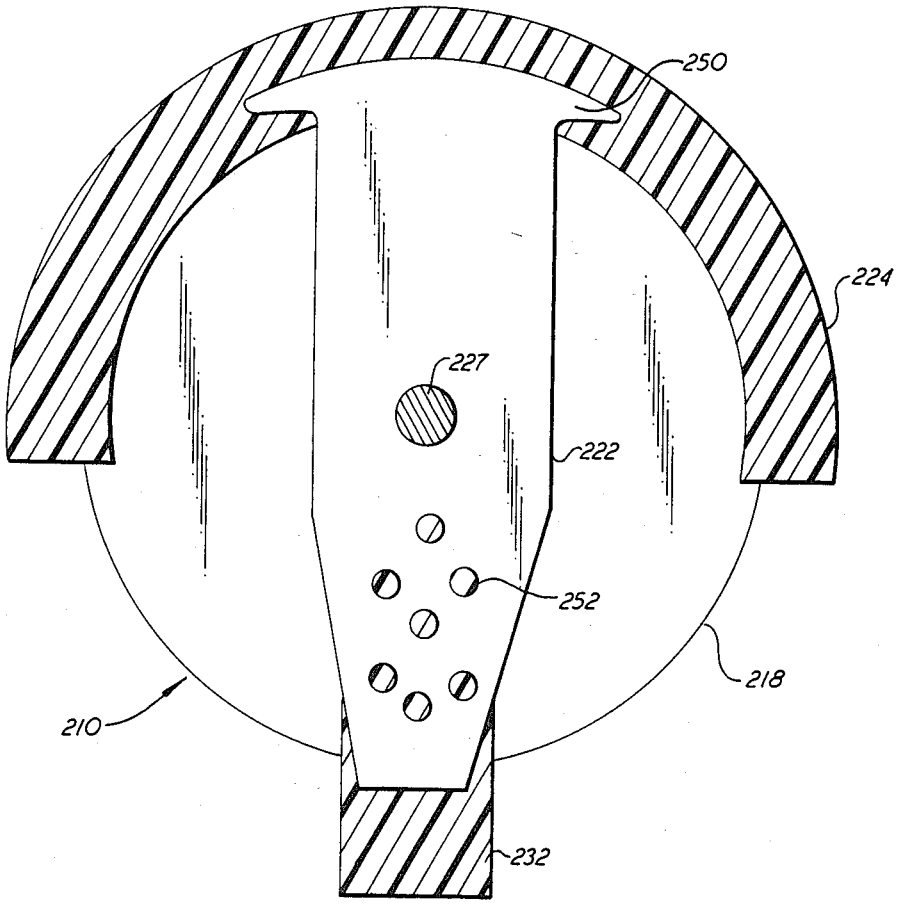
FIG. 18 is a sectional view taken along the lines of 18—18 of FIG. 14.
Figure 19:
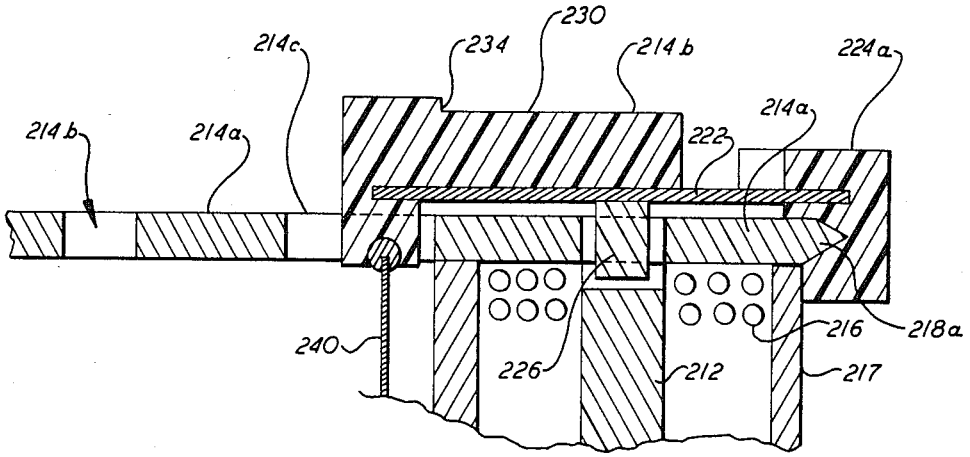
FIG. 19 is an upper cross-sectional view taken through a modified form of print head similar to that in FIG. 14.
Figure 21:
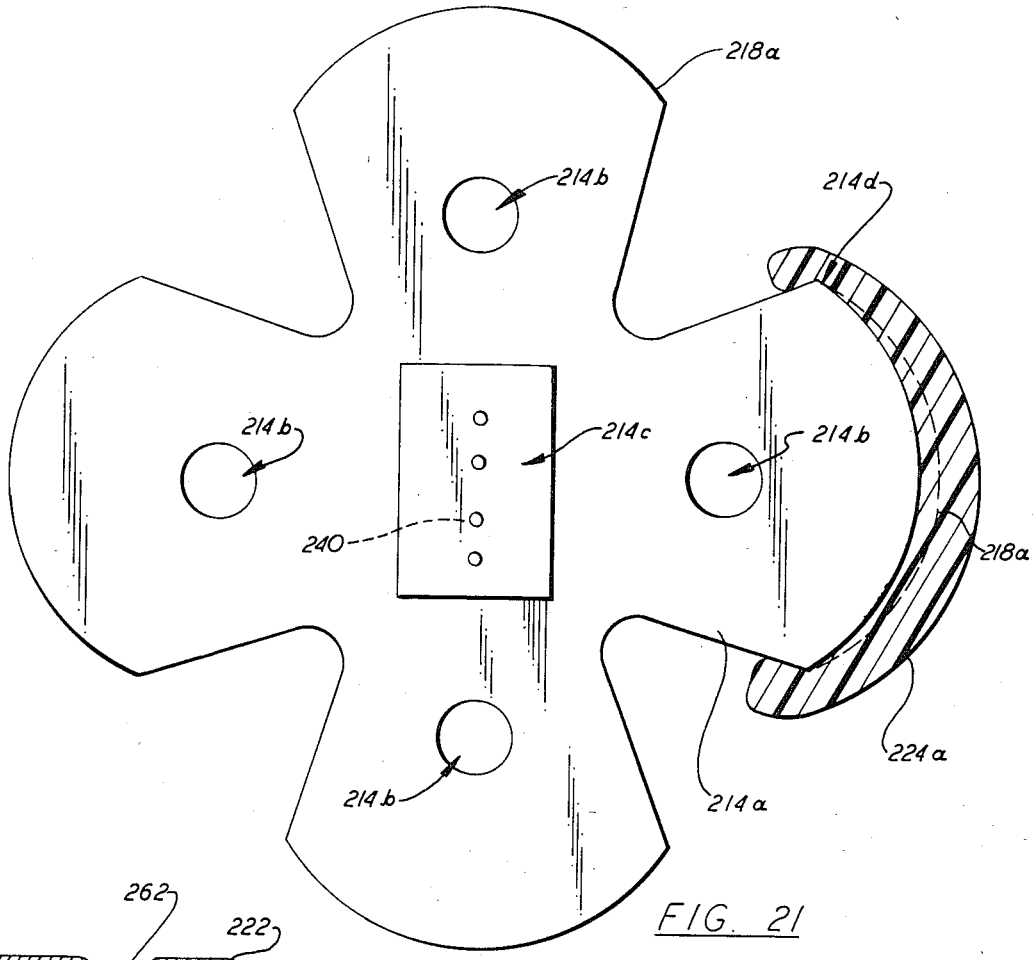
FIG. 21 is a plan view of a multibeam accommodating plate.

Referring now to FIGS. 19 and 21, there is shown still another embodiment of the invention wherein a common plate 214*a* serves as the magnet return path for all of a plurality of solenoids. In this embodiment, which is a slight modification of design of FIG. 18, a single multi-armed plate 214*a* serves as a return path for each of four solenoids. It will be appreciated that more solenoids may be provided. FIG. 19 is a partial sectional view similar to FIG. 18 showing one of the solenoids but with the plate extending beyond the single solenoid. In FIG. 21, there is a plan view of the multi-armed plate 214*a* showing one pair of arms 224*a* which are adapted to engage the triangular cross-section end 218*a* of the plate 214*a* and to extend around the corners 214*d* whereby the arms are held resiliently captive by the corners 214*d*. A hold 214*b* in each arm of the plate 214*a* permits passage of the armature 226 carried by the leaf spring 222. A central opening 214*c* provides spaces for the inner ends of the spring assemblies and their associated print pins 240 (shown in the hold 214*c*). In fact the pins 240 would not normally appear in the plane of the plate 214*a*.

Figure 22:
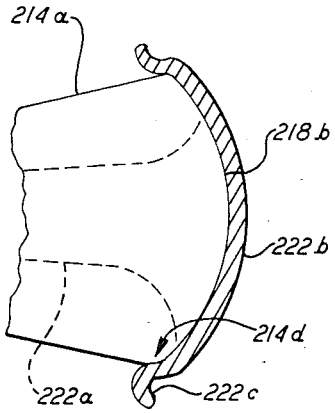
FIG. 22 is a modified form of construction of the beam accommodating plate of FIG. 21.

While one embodiment of an alternative arrangement of a multiarmed plate 214*a* is shown in FIGS. 19 and 21 numerous modifications can be employed without departing from the spirit of the invention. Additionally, the leaf spring itself may be provided with a detent which engages a corresponding hole in plate 214*a* to lock the spring assembly into position when it has been slid into the proper location on the plate 214*a*. In this embodiment (shown in FIG. 20) the end of the leaf spring can extend over the end of the plate 214*a*. The leaf spring 222 is provided with a pair of dimpled downwardly extending detents 262 (one only being shown) which match a pair of holes 260 in the metallic plate 214*a* of FIG. 19. Obviously, this detent could be in a plate such as plate 214 of FIG. 14. In both FIGS. 20 and 22 the cast arms 224 are omitted and the end of the leafspring is turned downwardly at 222*b* to extend around end 218*b* of plate 214*a*. In FIG. 22, the leaf spring is provided with inwardly extending arms 222*c* to grip the end of each arm 214*a*. The extent of the inward portion of the leaf spring 222 is shown in dotted lines at 222*a* in FIG. 22.

Figure 20:
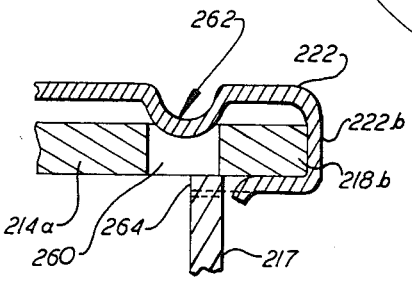
FIG. 20 is a section of a further modification of the embodiment of FIG. 14 showing the details of assembly.

In yet another variation, the detent/hole arrangement illustrated in FIG. 20 may be combined with a slot 264 in the upper edge of housing 217 (shown in ghost) and the portion of the leaf spring which extends downwardly around end 218*b* extends (as shown in ghost in FIG. 20) into this slot 264 to assist in correctly orienting the leaf spring 222 and the armature and print wire it carries.

Figure 23:
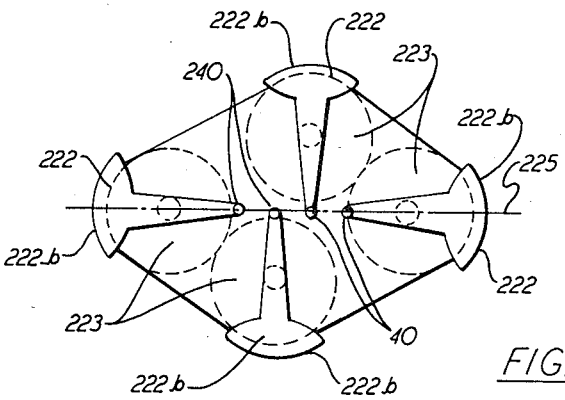
FIG. 23 is a schematic plan view of a four-pin matrix print head array constructed in accordance with the present invention.

In FIG. 23, there is illustrated a preferred geometric arrangement of a four pin dot matrix head having four leaf springs 222 driven by four armatures 226 for activating four print pins 240. In this case a multi-armed plate 214 of the type shown in FIGS. 4 and 5 supports the springs 222 at the ends 222*b* thereof by means such as shown in FIG. 20.

In FIG. 23, solenoids 223 and their associated pin assemblies are disposed as one opposed pair on the straight line 225 with a second pair disposed transversely of line 225 in opposed offset relationship to provide a linear row of equi-spaced pins 40.

I claim:

1. A print head for use in a multihead printing array comprising:

a solenoid case including a sidewall and a pair of opposed bases axially aligned on and connected with said sidwall, one of said bases having an aperture formed therein, said case being made of a magnetically permeable material, a core of magnetically permeable material defining a solenoid axis and extending within said case from the non-apertured base to a point adjacent the apertured base, said core defining a pole surface exposed to the exterior of the case by way of said aperture, a solenoid coil disposed in said case about said core, a beam, having a mounting end and a print pin support end, means rigidly mounting said mounting end of said beam relative to said case to overlie said aperture, an armature mounted to said beam, extending into said aperture and defining a pole surface positioned to form a working magnetic gap with said pole surface of said core, and a straight print pin rigidly attached to the print pin support end of said beam and extending substantially parallel to the axis of said solenoid, whereby movement of said beam and attached armature toward said solenoid moves said print pin substantially parallel to said axis for printing motion thereof, and a damper disposed to damp recoil energy of said beam, armature and print pin, said beam having a resilient portion disposed between said rigid mounting and said armature and being rigid from said armature to said print pin, and said damper comprising a resilient damper plug provided with means for adjusting the position of the damper relative to the beam and with means between the damper plug and the adjusting means which permits the damper plug to rotate whereby said plug moves during operation to progressively change the location of impact thereon of said print pin beam assembly on recoil.

2. A print head according to claim 1 wherein said pole surfaces are disposed at an angle to each other when said beam is at rest without any preload applied to the beam and are parallel to each other when the magentic gap is closed.

3. A print head according to claim 2 wherein said angle results from the disposition of said beam at a tilt angle relative to said apertured base.

4. A print head according to claim 3 wherein said tilt angle is provided by a tapered shim incorporated in said rigid mounting means.

5. A print head according to claim 3 wherein said tilt angle is provided by a bevelled surface to which said beam is mounted by said rigid mounting means.

6. A print head according to claim 2 wherein said angle is provided by bevelling at least one of said pole surfaces.

7. A print head according to claim 2 wherein said angle is from about 2° to about 5°.

8. A moveable print head assembly for a dot matrix line printer comprising a first plurality of print heads forming a first row above the print line, a second plurality of print heads forming a second row below a print line, means for mounting said first and second rows in staggered and opposed relation to each other to form a row of spaced print wires, said print heads being in accordance with claim 1.

9. A print head according to claim 1 wherein a portion of said beam is a leaf spring disposed between said mounting end and said armature, said beam being rigidly mounted at its mounting end as a cantilever, the length of said beam from the effective pivot axis of the beam to the print support end thereof being about 2.0 to about 4.0 times longer than the length from the effective pivot axis to the center of said armature.

10. A print head according to claim 9 wherein said length to the pin support end is 2.0 to 2.5 times longer than said length to said armature.

11. A print head according to claim 1 wherein said spring beam has a print pin driving stroke of between about 1 and about 3 degrees about its effective pivot axis.

12. A print head for use in a multihead printing array comprising:

a solenoid case including a sidewall and a pair of opposed bases axially aligned on and connected with said sidewall, one of said bases having an aperture formed therein, said case being made of a magentically permeable material, a core of magentically permeable material defining a solenoid axis and extending within said case from the non-apertured base to a point adjacent the apertured base, said core defining a pole surface exposed to the exterior of the case by way of said aperture, a solenoid coil disposed in said case about said core, a beam, having a mounting end and a print pin support end, means rigidly mounting said mounting end of said beam relative to said case to overlie said aperture, an armature mounted to said beam, extending into said aperture and defining a pole surface positioned to form a working magnetic gap with said pole surface of said core, and a straight print pin rigidly attached to the print pin support end of said beam and extending substantially parallel to the axis of said solenoid, whereby movement of said beam and attached armature toward said solenoid moves said print pin substantially prallel to said axis for printing motion thereof, a damper disposed to damp recoil energy of said beam, armature and print pin, said beam having a resilient portion disposed between said rigid mounting and said armature and being rigid from said armature to said print pin, and said pole surfaces being disposed at an angle to each other when said beam is at rest without any preload applied to the beam and being parallel to each other when the magnetic gap is closed, wherein said damper is a resilient damper plug provided with means for adjusting the position of the damper relative to the beam and with means disposed between said damper plug and said means for adjusting the same which permits the damper plug to rotate whereby said plug moves during operation to progressively change the location of impact thereon of said print pin beam assembly on recoil.

13. A print head for use in a multihead printing array comprising:

a solenoid case including a sidewall and a pair of opposed bases axially aligned on and connected with said sidewall, one of said bases having an aperture formed therein, said case being made of a magnetically permeable material, a core of magnetically permeable material defining a solenoid axis and extending within said case from the non-apertured base to a point adjacent the apertured base, said core defining a pole surface exposed to the exterior of the case by way of said aperture, a solenoid coil disposed in said case about said core, a beam, having a mounting end and a print pin support end, means rigidly mounting said mouting end of said beam relative to said case to overlie said aperture, an armature mounted to said beam, extending into said aperture and defining a pole surface positioned to form a working magnetic gap with said pole surface of said core, and a straight print pin rigidly attached to the print pin support end of said beam and extending substantially parallel to the axis of said solenoid, whereby movement of said beam and attached armature toward said solenoid moves said print pin substantially parallel to said axis for printing motion thereof, a damper disposed to damp recoil energy of said beam, armature and print pin, said beam having a resilient portion disposed between said rigid mounting and said armature and being rigid from said armature to said print pin, and said pole surfaces being disposed at an angle to each other when said beam is at rest without any preload applied to the beam and being parallel to each other when the magnetic gap is closed, wherein said damper is a resilient damper plug provided with means for adjusting the position of the damper relative to the beam and with said damper incorporating an inertial element having an mass equivalent to that of the effective moving mass of the beam, armature and print pin.

14. A print head according to claim 13 wherein said resilient damper includes said inertial element arranged to intercept the beam at its center of percussion.

* * * * *